US008905621B2

(12) United States Patent
Ekey et al.

(10) Patent No.: US 8,905,621 B2
(45) Date of Patent: Dec. 9, 2014

(54) LUMINAIRE ADAPTER WITH TOMBSTONE COVER

(71) Applicants: Timothy Ekey, Newton, MA (US); Douglas Harriott, Melrose, MA (US); Brandon Holley, Brookline, MA (US); Fernando Aguiar, Westport, MA (US)

(72) Inventors: Timothy Ekey, Newton, MA (US); Douglas Harriott, Melrose, MA (US); Brandon Holley, Brookline, MA (US); Fernando Aguiar, Westport, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 74 days.

(21) Appl. No.: 13/691,380

(22) Filed: Nov. 30, 2012

(65) Prior Publication Data

US 2013/0141923 A1 Jun. 6, 2013

Related U.S. Application Data

(60) Provisional application No. 61/565,496, filed on Nov. 30, 2011, provisional application No. 61/724,804, filed on Nov. 9, 2012.

(51) Int. Cl.
*F21V 21/00* (2006.01)
*F21V 15/015* (2006.01)

(52) U.S. Cl.
CPC ..... *F21V 21/00* (2013.01); *F21V 15/015* (2013.01)
USPC ..... 362/656; 362/432

(58) Field of Classification Search
USPC ..... 362/217.12, 217.13, 656, 432
See application file for complete search history.

(56) References Cited

U.S. PATENT DOCUMENTS

| | | | | |
|---|---|---|---|---|
| 8,439,517 | B2 * | 5/2013 | Welker | 362/217.11 |
| 2007/0127244 | A1 | 6/2007 | Cunius | |
| 2011/0038148 | A1 | 2/2011 | Pyle | |
| 2012/0062129 | A1 | 3/2012 | Szoradi et al. | |
| 2013/0182427 | A1 * | 7/2013 | Khanampornpan | 362/217.17 |

FOREIGN PATENT DOCUMENTS

| | | |
|---|---|---|
| AU | 2009 101 287 A4 | 1/2010 |
| EP | 2 270 933 A1 | 1/2011 |

OTHER PUBLICATIONS

Philips EnduraLED SA1 and SA2 tubes, Sep. 2011, pp. 1-4, Form No. LE-6410-C, Philips Lighting Electronics N.A., Rosemont, Illinois, United States of America.

Wim Amerongen, International Search Report and Written Opinion of the International Searching Authority for PCT/US2012/067435, Feb. 14, 2013, pp. 1-7, European Patent Office, Rijswijk, The Netherlands.

* cited by examiner

*Primary Examiner* — Tracie Y Green
(74) *Attorney, Agent, or Firm* — Shaun P. Montana

(57) ABSTRACT

A luminaire adapter is provided. The luminaire adapter includes a tombstone cover and a light source bracket. The tombstone cover includes a housing that defines a slot opening to accept a tombstone socket and a pair of snap connectors. The light source bracket includes a top portion and a bottom portion. The top portion and the bottom portion are configured to connect. The bottom portion includes a pair of snap receivers configured to receive the pair of snap connectors of the tombstone cover. The top portion and the bottom portion define an opening to receive a luminaire.

20 Claims, 9 Drawing Sheets

LUMINAIRE ADAPTER WITH TOMBSTONE COVER

CROSS-REFERENCE TO RELATED APPLICATIONS

The present application claims priority of U.S. Provisional Application No. 61/565,496, filed Nov. 30, 2011 and entitled "RETROFIT FLUORESCENT TOMBSTONE COVER AND MATING CONNECTOR", and U.S. Provisional Application No. 61/724,803, filed Nov. 9, 2012 and entitled "ADJUSTABLE END CONNECTORS AND CENTERING POSITIONER FOR LINEAR SOLID STATE LIGHT SOURCES AND LUMINAIRES", the entire contents of both of which are hereby incorporated by reference.

TECHNICAL FIELD

The present invention relates to lighting, and more specifically, to luminaires including solid state light sources.

BACKGROUND

A typical fluorescent tube lamp socket (commonly referred to in the art as a tombstone socket or simply a tombstone) is adapted to receive the one or more pins traditionally located on the end caps of a fluorescent lamp. The tombstone provides electricity to the lamp as well as mechanical support for the lamp. A tombstone is sometimes a removable part of a larger system (e.g., fluorescent lamp fixture, display case, refrigeration case, etc.) and is sometimes integral with the larger system.

SUMMARY

Solid state light sources (such as but not limited to light emitting diodes (LEDs), organic light emitting diodes (OLEDs), polymer light emitting diodes (PLEDs), and the like), and fixtures/luminaires containing the same, are being used more frequently to replace traditional light sources (e.g., incandescent, halogen, low-pressure discharge (i.e., fluorescent), high-pressure discharge (i.e., metal halide, sodium, etc.), etc.) and/or fixtures containing the same. Most retrofit solid state light source-based lamps designed to replace typical incandescent lamps (e.g., A19 lamps with screw bases or GU-24 bases) are designed with the same base, so that they will fit into the same socket, and thus may be operated from the same power source (i.e., AC mainline power). Some retrofit solid state light sources (either lamps or fixtures) designed to replace fluorescent tube lamps do not include the same bi-pin bases of the fluorescent tube lamp, which of course are designed to fit into tombstone sockets. This is because the solid state light sources typically are not able to be operated via the ballast that powers a fluorescent lamp. Rather, a solid state light source typically requires its own power supply (also referred to as a driver), whether as a separate unit or integral with the retrofit lamp/fixture. The retrofit solid state light source(s) (in either a lamp or a fixture), however, is supposed to occupy the same space. In some retrofit applications, the solid state light source lamp/fixture is secured in the space previously occupied by a fluorescent tube lamp by using metal snap brackets that need to be fastened to a stationary object using screws, or by removing the existing tombstone sockets and replacing them with a particular part designed for that particular lamp/fixture. This is time-consuming and costly. The costs, in terms of time and money, are increased in situations where the tombstone sockets were not designed to be removed from the existing installation.

Embodiments of the present invention provide a cover for the typical fluorescent tombstone sockets that mates to a connector that is easily attached to the retrofit solid state light source(s) (in either a lamp or a fixture). Embodiments provide an easy-to-install, tool-free and/or almost tool-free way to secure a retrofit lamp/fixture to a stationary object. Some embodiments include mating connectors that could be employed on a number of different objects for retrofit applications as well as new construction applications. Other embodiments provide for a single piece that covers a tombstone socket and is additionally mechanically attached (for example, via screws) to the existing fixture.

In an embodiment, there is provided a luminaire adapter. The luminaire adapter includes: a tombstone cover, wherein the tombstone cover comprises a housing that defines a slot opening to accept a tombstone socket and a pair of snap connectors; and a light source bracket, wherein the light source bracket comprises a top portion configured to connect to a bottom portion, wherein the bottom portion includes a pair of snap receivers configured to receive the pair of snap connectors, and wherein the top portion and the bottom portion define an opening to receive a luminaire.

In a related embodiment, the housing may include a front wall, a back wall, a pair of side walls, and a housing top, and the front wall may include the pair of snap connectors.

In a further related embodiment, each snap connector in the pair of snap connectors may include a first tab and a second tab, the first tab and the second tab for each snap connector may define a snap opening to receive a corresponding snap receiver of the pair of snap receivers. In a further related embodiment, for at least one snap connector in the pair of snap connectors, the first tab and the second tab may be oriented such that the snap opening is parallel to the housing top. In another further related embodiment, the first tab and the second tab of a first snap connector in the pair of snap connectors may be oriented such that a first snap opening is parallel to the housing top, and the first tab and the second tab of a second snap connector in the pair of snap connectors may be oriented such that a second snap opening is perpendicular to the housing top.

In another further related embodiment, the tombstone cover may include a first pair of snap connectors and a second pair of snap connectors, and the front wall may include the first pair and the second pair of snap connectors.

In a further related embodiment, each snap connector in the first pair and the second pair of snap connectors may include a first tab and a second tab, and the first tab and the second tab for each snap connector may define a snap opening to receive a corresponding snap receiver of the pair of snap receivers. In a further related embodiment, the first tab and the second tab of a first snap connector in the first pair of snap connectors may be oriented in a different direction from the first tab and the second tab of a second snap connector in the first pair of snap connectors, and the first tab and the second tab of a first snap connector in the second pair of snap connectors may be oriented in a different direction from the first tab and the second tab of a second snap connector in the second pair of snap connectors. In another further related embodiment, the first pair of snap connectors may be oriented parallel to the housing top and the second pair of snap connectors may be oriented perpendicular to the housing top.

In another further related embodiment, the light source bracket may include a first pair of snap receivers configured to receive the first pair of snap connectors and a second pair of snap receives configured to receive the second pair of snap connectors.

In still another further related embodiment, the front wall, the back wall, and each of the pair of side walls may have an upper portion and a lower portion.

In a further related embodiment, the lower portion of the front wall and the lower portion of the back wall may each be substantially wider than the upper portion of the front wall and the upper portion of the back wall. In a further related embodiment, the upper portion of each side wall may be substantially perpendicular in relation to the housing top, and the lower portion of each side wall may be angled with respect to the upper portion.

In another further related embodiment, the pair of snap connectors may be located on the lower portion of the front wall.

In another related embodiment, the top portion may include a first end and a second end, the bottom portion may include a rotating end and a receiving end, the first end may be rotationally connected to the rotating end and the second end may be removably connected to the receiving end. In a further related embodiment, the second end may include a top clip connected to a push tab, the receiving end may include a bottom clip, and the top clip and the bottom clip, when engaged, may be configured to retain a luminaire in the opening, and the push tab may be configured to allow the top clip and the bottom clip to be disengaged.

In still another related embodiment, the top portion may include a first end and a second end, the first end and the second end may each include a push tab connected to a corresponding top clip, the bottom portion may include a first receiving end and a second receiving end, each configured to engage a corresponding top clip of the top portion so as to retain a luminaire in the opening, and the push tab of the first end and the push tab of the second end may each be configured to allow the corresponding top clip to be disengaged from its respective receiving end.

In yet still another related embodiment, the bottom portion may include a first pressure clip and a second pressure clip, and the first pressure clip and the second pressure clip may be configured to engage with a plurality of teeth of a luminaire in the opening when the top portion is connected to the bottom portion so as to allow the luminaire to rotate while simultaneously allowing the luminaire adapter to be stationary.

In still yet another related embodiment, the bottom portion and the top portion may include a plurality of grooves, the plurality of grooves may be configured to match a corresponding plurality of teeth on a luminaire, and the plurality of grooves may be configured to interact with the corresponding plurality of teeth to allow the luminaire to rotate while simultaneously allowing the luminaire adapter to be stationary.

In yet still another related embodiment, the tombstone cover may include the pair of snap receivers and the light source bracket may include the pair of snap connectors.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
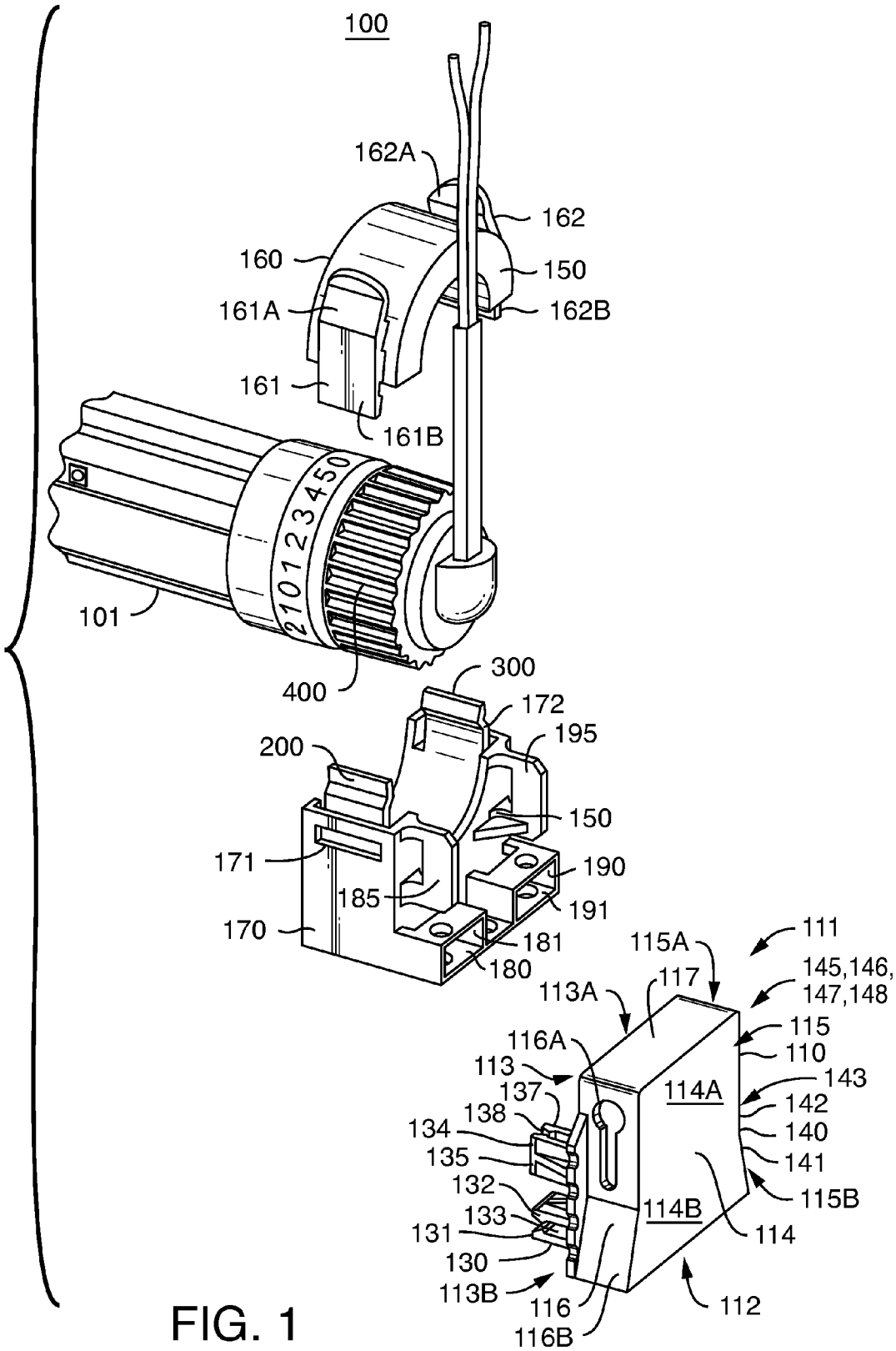
FIG. 1 shows an exploded view of a luminaire adapter and a portion of a luminaire according to embodiments disclosed herein.

FIG. 1 shows an exploded view of a luminaire adapter 100 for a luminaire 101 (a part of which is shown in FIGS. 1-4). The luminaire adapter 100 allows a solid state light source-based luminaire (such as but not limited to the luminaire 101 shown in FIGS. 1-5) to be put in place of a fluorescent lamp without removing the tombstone sockets that held and powered the fluorescent lamp. The luminaire adapter 100 includes a tombstone cover 110 and a light source bracket 150. The tombstone cover 110 covers a tombstone socket (not shown in FIG. 1). The light source bracket 150 connects to the luminaire 101 (for example but not limited to at an end of the luminaire 101) and then is itself connected to the tombstone cover 110. In some embodiments, the light source bracket is connected to the tombstone cover 110 first, and then the luminaire 101 is connected to the light source bracket 150. The luminaire adapter 100 (shown with its component parts joined together in FIG. 2 and connected to an end of the luminaire 101) thus holds the luminaire 101 in at least part of the same space that was previously occupied by a fluorescent lamp.

The tombstone cover 110 has a housing 111. The housing 111 defines a slot opening 112 to accept a tombstone socket. In some embodiments, the housing 111 includes a front wall 113, a back wall 114, a pair of side walls 115 and 116, and a housing top 117. The housing top 117, in some embodiments, is above the top of a tombstone socket. It should be noted that directions used herein (i.e., top, bottom, upper, lower, etc.) are in regard to a particular orientation as shown in the figures for ease of explanation, and are not limiting in any way. Thus, for example, as is well known in the art, a tombstone socket may be connected to the underside of a shelf, such that the "top" of the tombstone socket faces the floor as opposed to the ceiling, and in such situations, the housing top 117 of the tombstone cover 110 would be below the "top" of the tombstone socket. The front wall 113, on its interior, faces the portion of the tombstone that accepts the pin and/or pins of a fluorescent lamp, with the back wall 114 being opposite the front wall 113. The pair of side walls 115 and 116 couple the front wall 113 to the back wall 114 along with the housing top 117 to form the slot opening 112. In some embodiments, the front wall 113, the back wall 114, and each of the pair of side walls 115 and 116 has an upper portion (113A, 114A, 115A, 116A) and a lower portion (113B, 114B, 115B, 116B). Each upper portion 113A, 114A, 115A, 116A includes the part of the respective wall that is nearest the housing top 117. Each lower portion 113B, 114B, 115B, 116B includes the part of the respective wall that is nearest the slot opening 112. In some embodiments, to be able to accommodate different shapes of tombstone sockets, the lower portion 113B of the front wall 113 and the lower portion 114B of the back wall 114 are each substantially wider than the upper portion 113A of the front wall 113 and the upper portion 114A of the back wall 114. In some embodiments, this results in the pair of side walls 115 and 116 being slanted from the housing top 117 to the slot opening 112. In some embodiments, only the lower portion 115B, 116B of the pair of side walls 115 and 116 is so slanted. In other words, in such embodiments, the upper portion 115A, 116A of each side wall 115, 116 is substantially perpendicular in relation to the housing top 117, and the lower portion 115B, 116B of each side wall 115, 116 is angled with respect to the upper portion 115A, 116A. Of course, the housing 111, in other embodiments, takes different shapes that are all capable of covering a tombstone socket. In some embodiments, the tombstone cover 110 simply sits on a tombstone socket and may be removed from the tombstone simply by lifting the tombstone cover 110. In some embodiments, the tombstone cover 110 is coupled, at least in part, to at least a portion of a tombstone socket by any known coupling mechanism, such as but not limited to friction, tensioning, bonding (i.e., glue, cement, epoxy, etc.), mechanical coupler (e.g., screw, clip, etc.) or the like. In some embodiments, the tombstone cover 110 is coupled to a surface that is near the tombstone, using any known coupling mechanism, such as but not limited to those described above.

Figure 2:
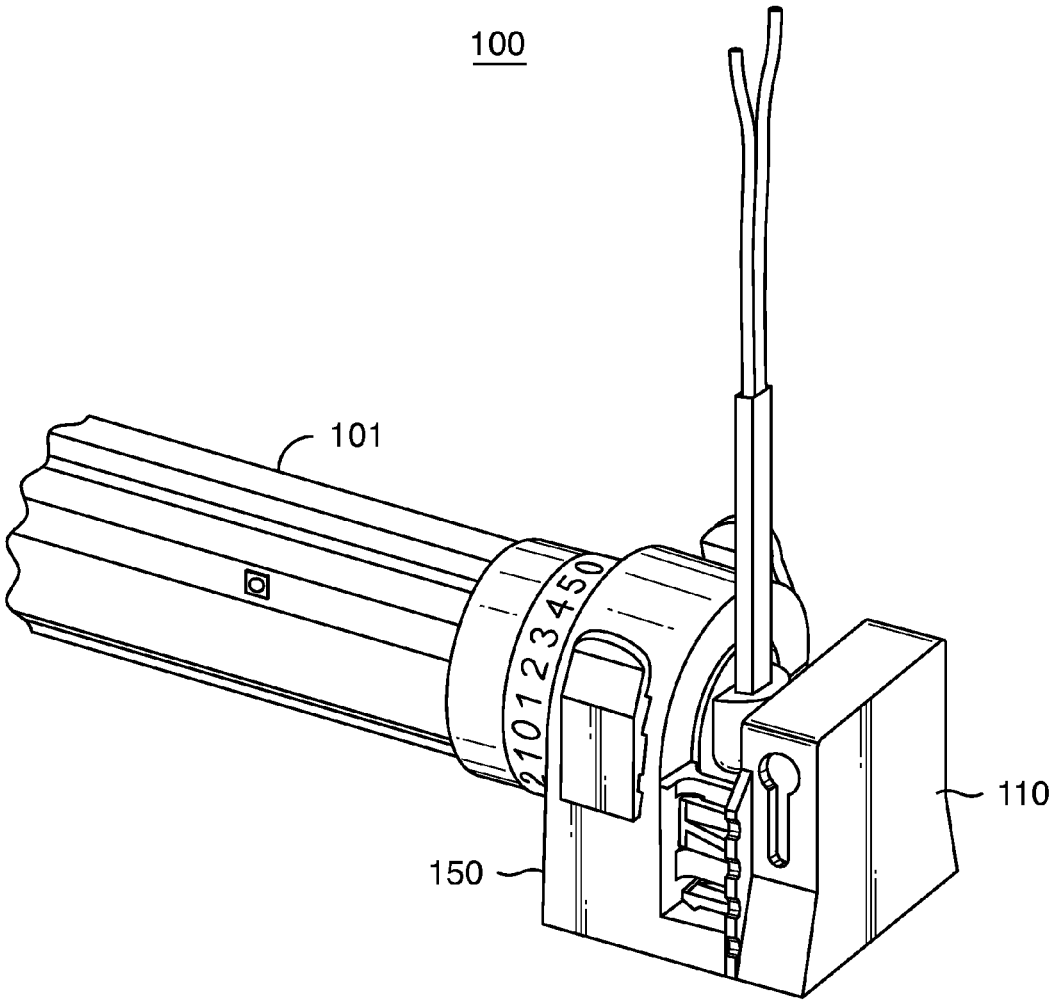
FIG. 2 shows the luminaire adapter of FIG. 1 attached to a luminaire according to embodiments disclosed herein.

A pair of snap connectors 130 and 140 is also part of the tombstone cover 110. In some embodiments, the pair of snap connectors 130 and 140 is attached to the front wall 113 of the housing 111. The pair of snap connectors 130 and 140 mechanically interacts with a corresponding pair of snap receivers 180 and 190 on the light source bracket 150 to couple the tombstone cover 110 with the light source bracket 150. In some embodiments, such as shown in FIGS. 1 and 2, each snap connector in the pair of snap connectors 130, 140 includes a first tab 131, 141 and a second tab 132, 142. Each tab 131, 132, 141, 142 extends out from the front wall 113. Each tab 131, 132, 141, 142 may, and in some embodiments does, include a protrusion or other similar feature that allows the snap connector 130, 140 to grab onto its corresponding snap receiver 180, 190. The first tab 131, 141 and the second tab 132, 142 for each snap connector 130, 140 define a snap opening 133, 143 to receive a corresponding snap receiver of the pair of snap receivers 180, 190. The snap opening 113, 143 receives a portion of the corresponding snap receiver 180, 190 when the tombstone cover 110 is coupled to the light source bracket 150. In some embodiments, a first tab 131, 141 and second tab 132, 142 are oriented such that the snap opening 133, 143 is parallel to the housing top 117. In some embodiments, the first tab 131, 141 the second tab 132, 142 are oriented such that the snap opening 133, 143 is perpendicular to the housing top 117 and/or at an angle with respect to a plane including the housing top 117. In some embodiments, the first snap connector 130 (and thus the first tab 131 and the second tab 132) is oriented such that the first snap opening 133 is parallel to the housing top 117, and the second snap connector 140 (and thus the first tab 141 and the second tab 142) is oriented such that the second snap opening 143 is perpendicular to the housing top 117.

In some embodiments, the tombstone cover 110 includes a first pair of snap connectors 130, 140 and a second pair of snap connectors 135, 145. The second pair of snap connectors 135, 145 each includes a first tab 136, 146, a second tab 137, 147, and a snap opening 138, 148, similar to the first pair of snap connectors 130, 140. The snap openings 138, 148 receive a corresponding snap receiver 185, 195 (i.e., a second pair of snap receivers 185, 195) of the light source bracket 150. In some embodiments, such as shown in FIGS. 1 and 2, the front wall 113 includes the first pair of snap connectors 130, 140 and the second pair of snap connectors 135, 145. In some embodiments, the second pair of snap connectors 135, 145 is located on the pair of side walls 115, 116, and/or on the back wall 114. As with the first tab 131, 141 and the second tab 132, 142 of the first pair of snap connectors 130, 140, the first tab 136, 146 and the second tab 137, 147 of the second pair of snap connectors 135, 145 are, in some embodiments, oriented in the same direction (e.g., parallel to the housing top 117, perpendicular to the housing top 117, at an angle with respect to the plane of the housing top 117), and in some embodiments, oriented in different directions. In some embodiments, one snap connector of the first pair of snap connectors 130, 140 is oriented in the same direction (i.e., a first direction) as one snap connector in the second pair of snap connectors 135, 145, while the other snap connector of the first pair of snap connectors 130, 140 and the other snap connectors in the second pair of snap connectors 135, 145 are oriented in a different direction (i.e., a second direction). As shown in FIGS. 1 and 2, the first pair of snap connectors 130, 140 are oriented parallel to the housing top 117 and the second pair of snap connectors 135, 145 are oriented perpendicular to the housing top 117.

As shown in FIGS. 1-2, the light source bracket 150 includes a top portion 160 configured to connect to a bottom portion 170. The bottom portion 170 includes a pair of snap receivers 180, 190 configured to receive the pair of snap connectors 130, 140 of the tombstone cover 110. The pair of snap receivers 180, 190 take any shape that is capable of interacting with one or more distinct pairs of snap connectors (such as but not limited to the snap connectors 130, 140 shown in FIGS. 1-2). The pair of snap receivers 180, 190 each define a receiving opening 181, 191 into which a tab 131, 132, 141, 142 of the snap connectors 130, 140 is inserted when the light source bracket 150 is coupled to the tombstone cover 110. Each other tab 131, 132, 141, 142 of the snap connectors 130, 140 is thus outside of the receiving opening 181, 191. Though the pair of snap receivers 180, 190 is shown having such a configuration in FIGS. 1 and 2, other configurations are possible. For example, the second pair of snap receivers 185, 195 also shown in FIGS. 1-2 do not define an opening, but rather are tabs that protrude from the light source bracket 150 (more specifically, the bottom portion 170, though in some embodiments, at least one of the second pair of snap receivers 185, 195 protrudes from the top portion 160). The second pair of snap connectors 135, 145 thus surrounds the second pair of snap receivers 185, 195 instead of having a tab that inserts into a receiving opening and a tab that is outside of the receiving opening.

Figure 3:
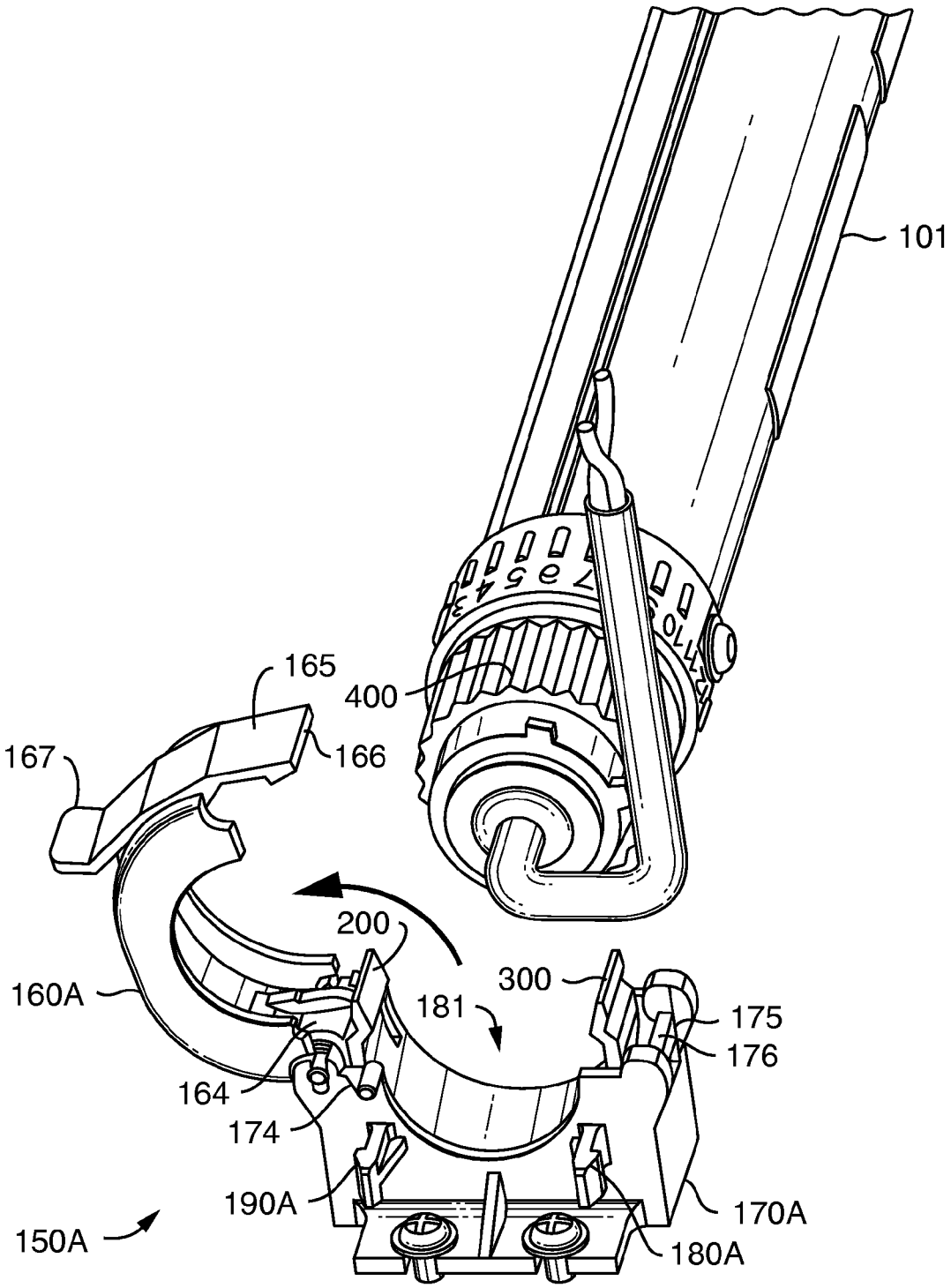
FIG. 3 shows a light source bracket of a luminaire adapter open to receive a luminaire according to embodiments disclosed herein.
Figure 4:
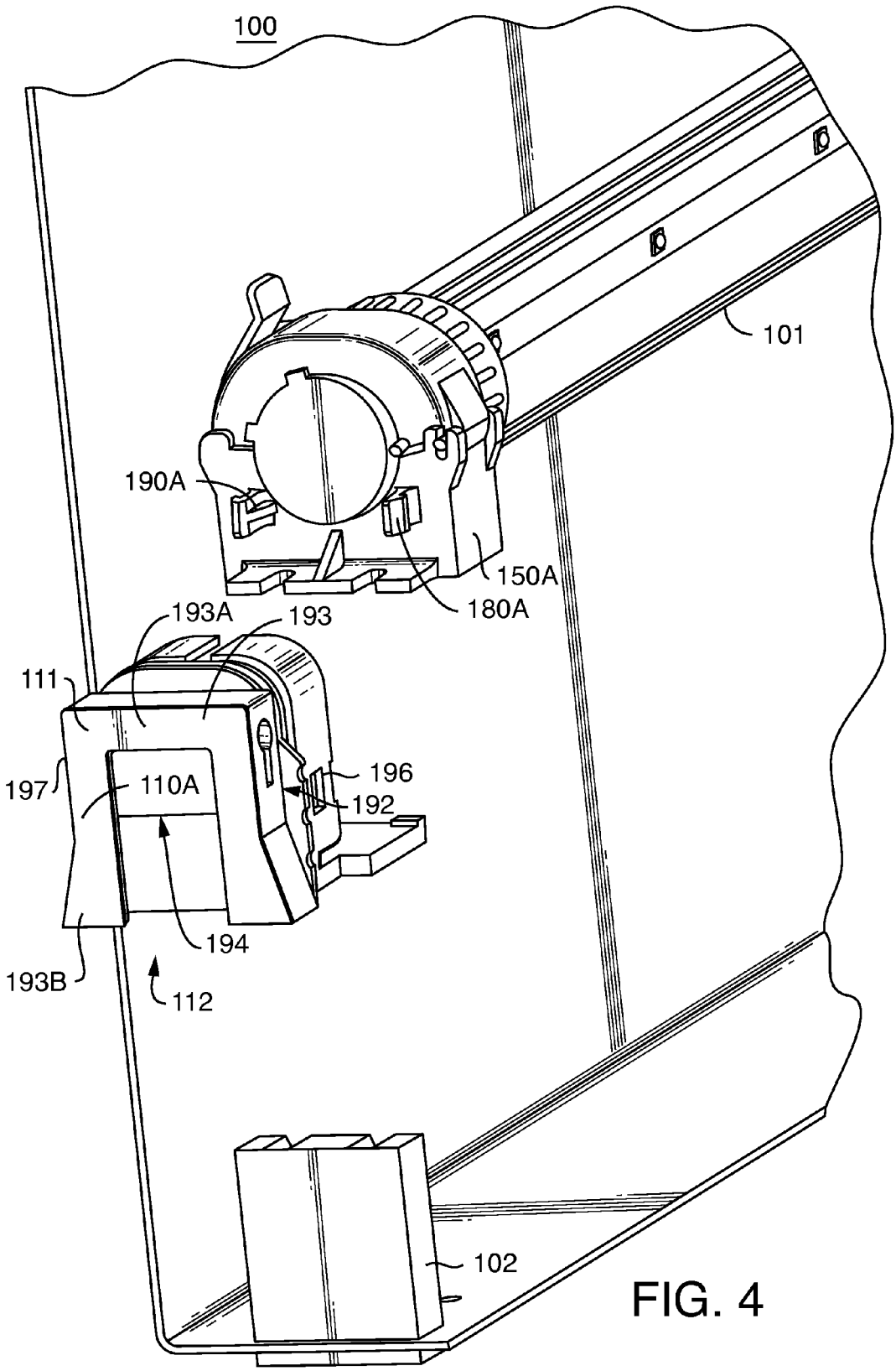
FIG. 4 shows the light source bracket of FIG. 3 connected to the luminaire, a tombstone cover, and a tombstone socket, according to embodiments disclosed herein.
Figure 5:
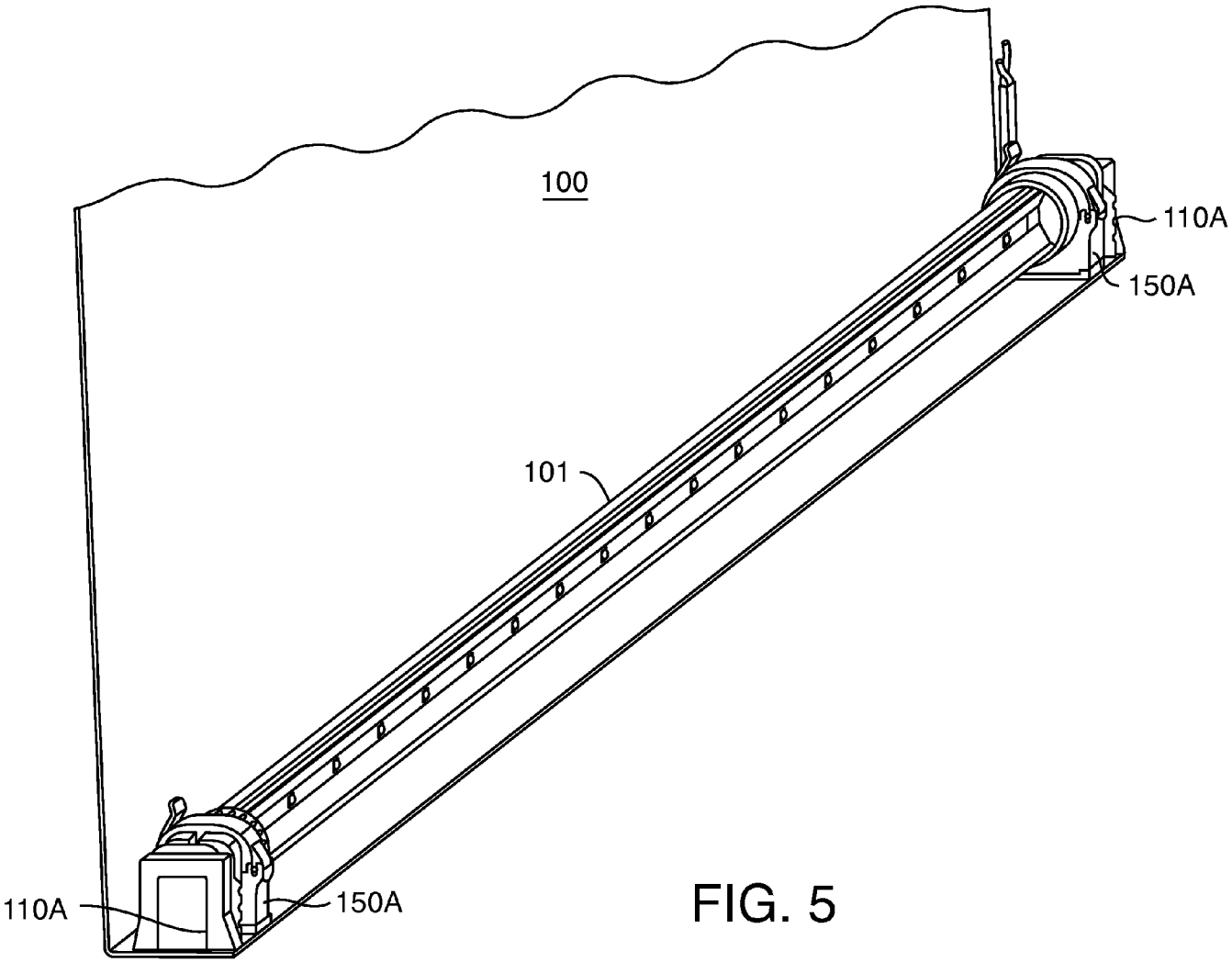
FIG. 5 shows a luminaire with the luminaire adapter of FIGS. 3 and 4 on either side of the luminaire covering two tombstone sockets, according to embodiments disclosed herein.

The top portion 160 and the bottom portion 170 define an opening 181 (seen most clearly in FIG. 3) to receive the luminaire 101. In FIGS. 1-2, the top portion 160 comprises a first end 161 and a second end 162. The first end 161 and the second end 162 each comprise a push tab 161A, 162A connected to a corresponding top clip 161B, 162B. The top clips 161B, 162B protrude out from the top portion 160 and allow the top portion 160 to be connected to the bottom portion 170. The bottom portion 170 comprises a first receiving end 171 and a second receiving end 172, each configured to engage a corresponding top clip 161B, 162B of the top portion 160 so as to retain the luminaire 101 in the opening 181. The push tab 161A of the first end 161 and the push tab 162A of the second end 162 are each configured to allow the corresponding top clip 161B, 162B to be disengaged from its respective receiving end 171, 172. Thus, in order to place a luminaire in the light source bracket 150, the push tabs 161A, 162A are engaged so as to remove the top portion 160 entirely from the bottom portion 170. After the luminaire is placed in the light source bracket 150, the top portion 160 is snapped, via the top clips 161B, 162B, into the bottom portion 170. In some embodiments, such as shown in FIGS. 3-5, a light source bracket 150A includes a top portion 160A and a bottom portion 170A. The top portion 160A comprises a first end 164 and a second end 165. The bottom portion 170A comprises a rotating end 174 and a receiving end 175. The first end 164 is rotationally connected to the rotating end 174 and the second end 165 is removably connected to the receiving end 175. Thus, to place a luminaire in the opening 181 of the light source bracket 150A, a user rotates the second end 165 of the top portion 160A away from the bottom portion 170A. To secure the luminaire in the light source bracket 150A, the user rotates the second end 165 towards the bottom portion 170A until the second end 165 engages with the receiving end 175. The luminaire 101 secured in the luminaire adapter 100 is shown in FIGS. 4 and 5. In some embodiments where the top portion 160A is rotatable in relation to the bottom portion 170A, the second end 165 includes a top clip 166 connected to a push tab 167, while the receiving end 175 comprises a bottom clip 176. The top clip 166 and the bottom clip 176, when engaged, are configured to retain a luminaire in the opening 181. The push tab 167 is configured to allow the top clip 166 and the bottom clip 176 to be disengaged.

Note that the light source bracket 150A of FIGS. 3-5 includes not a pair of snap receivers but rather a pair of snap connectors 180A, 190A. The pair of snap connectors 180A, 190A is shown in FIGS. 3-5 as a pair of tabs extending from the light source bracket 150A with a protrusion on the end of each tab, though of course, any known type of connector may be used. FIG. 4 shows a tombstone cover 110A that includes a housing 111 that defines a slot opening 112 to receive a tombstone socket 102. Unlike the tombstone cover 110 shown in FIGS. 1 and 2, a back wall 193 includes a back opening 194 that extends from a lower portion 193B of the back wall 193 to an upper portion 193A of the back wall 193. Further, the tombstone cover 110A includes a pair of snap receivers 196, 197 that are located on respective curves protruding from a front wall 192 of the tombstone cover 110A. Here, the snap receivers 196, 197 are openings in the curves that will receive the protrusions of the tabs of the snap connectors 180A, 190A. FIG. 5 then shows the entire luminaire 101 secured over the tombstone 102 via the luminaire adapter 100.

In some embodiments, such as shown in FIGS. 1 and 3, the bottom portion 170/170A includes two pressure clips 200, 300. The pressure clips 200, 300 extend from a location on the bottom portion 170/170A that forms the opening 181. The pressure clips 200, 300 are configured to engage with a plurality of teeth 400 of the luminaire 101 when the luminaire 101 is in the opening 181. In some embodiments, the top portion 160/160A connects to the bottom portion 170/170A, which pushes the pressure clips 200, 300 into contact with the plurality of teeth 400. The pressure clips 200, 300 allow the luminaire 101 to rotate while simultaneously allowing the luminaire adapter 100 to be stationary. Of course, in some embodiments, the luminaire 101 mechanically interacts with the pressure clips 200, 300 via other mechanisms, such as but not limited to a plurality of tabs. The pressure clips 200, 300 are sized appropriately to mechanically interact with the luminaire 101, allowing rotation of the luminaire 101.

In some embodiments, the parts of the top portion 160/160A and the bottom portion 170/170A that define the opening 181 include a mechanical mechanism that allows for interaction with the plurality of teeth 400 or other shaping on the luminaire 101 for rotation. For example, the top portion 160/160A and the bottom portion 170/170A may include a plurality of grooves that are configured to match a corresponding plurality of teeth on the luminaire 101. The plurality of grooves are configured to interact with the corresponding plurality of teeth to allow the luminaire 101 to rotate while simultaneously allowing the luminaire adapter 100 to be stationary. The plurality of grooves, the plurality of teeth, and/or both allow for the luminaire 101 to be placed in one or more particular positions, as described in greater detail below.

In some embodiments wherein a first luminaire adapter is placed on one end of a luminaire and a second luminaire adapter is placed on the opposite end of the luminaire (see FIG. 5), both the first luminaire adapter and the second luminaire adapter allow for rotational adjustment. In some embodiments, the first luminaire adapter allows the luminaire to be rotationally adjustable while the second luminaire adapter allows the luminaire to free spin, such that the first luminaire adapter's interaction with the luminaire control the position of the luminaire. The position of the luminaire may be, and in some embodiments, is denoted by markings on the luminaire, such as but not limited to numbers as shown in FIGS. 1 and 2. The markings identify different positions to a user that correspond to directions of light emitted by the luminaire. A user is thus able to use the markings to determine a desired position of the luminaire without having to provide power the luminaire. Particularly in applications where the lumens output by the luminaire are quite high (i.e., the light emitted by the luminaire is very bright), this provides significant advantages to installers and to users. In some embodiments where only one side of the luminaire is able to rotate, the first luminaire adapter allows for rotation while the second luminaire adapter hold the other side of the luminaire stationary. In such embodiments, the markings may be only on the side of the luminaire that is able to rotate, though in some embodiments, the markings are on both sides. This allows the luminaire to be installed with either end in a respective luminaire adapter.

Figure 6A:
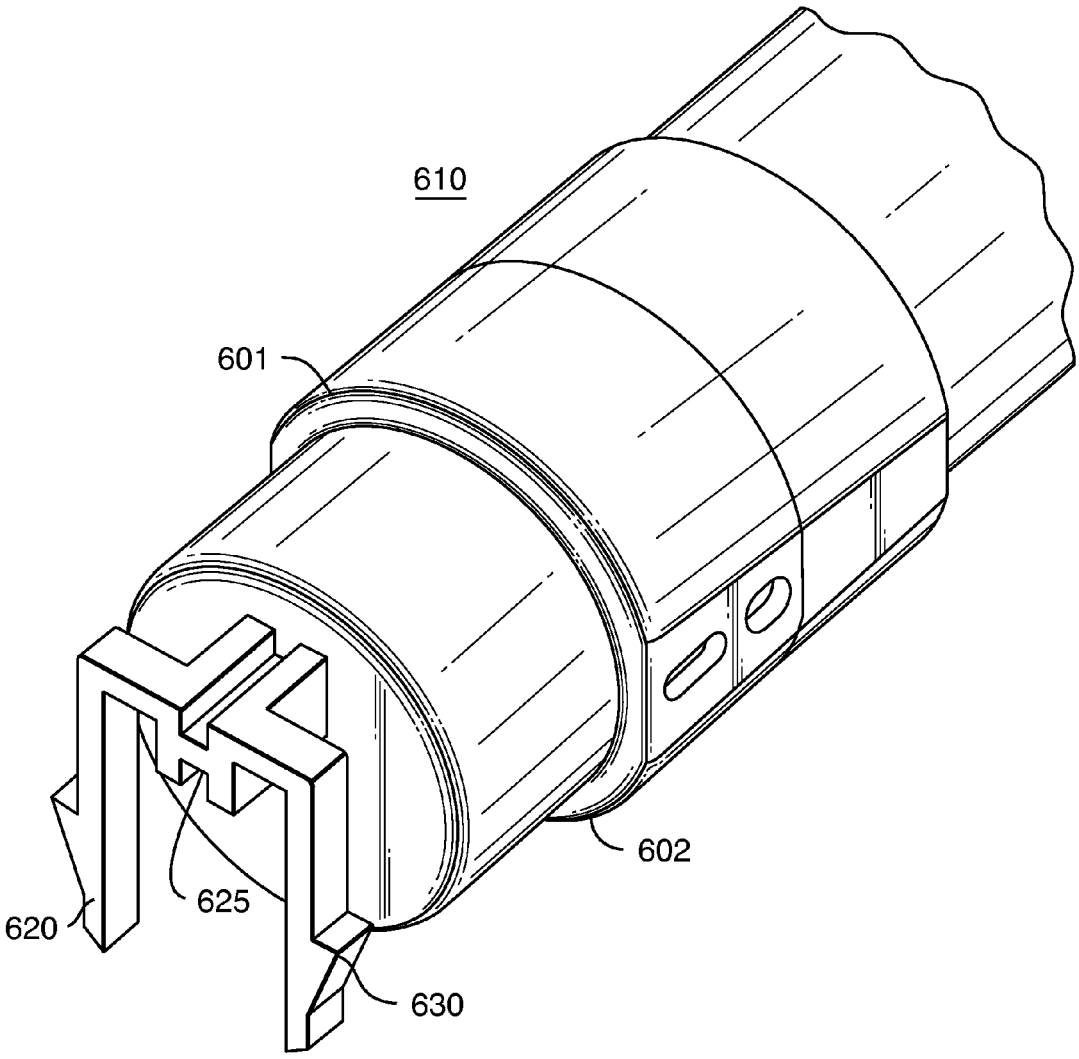
FIGS. 6A and 6B show a tombstone cover and a light source bracket according to embodiments disclosed herein.
Figure 6B:
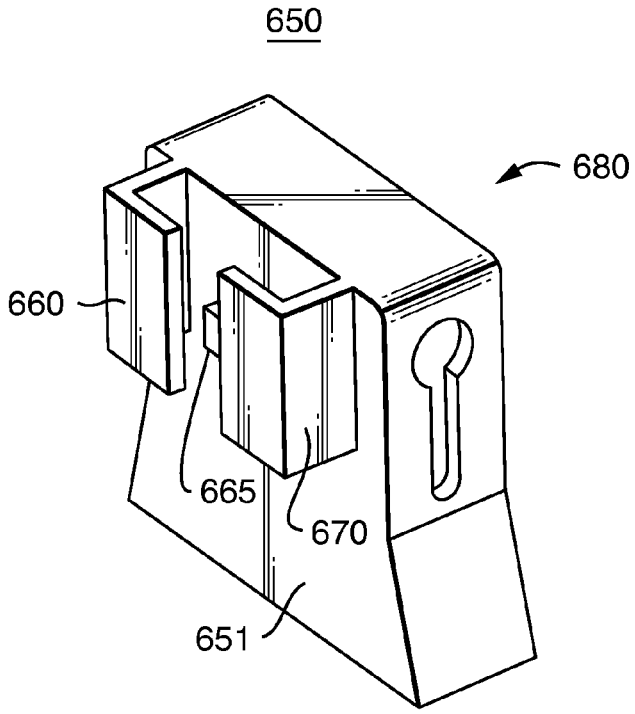
Figure 7A:
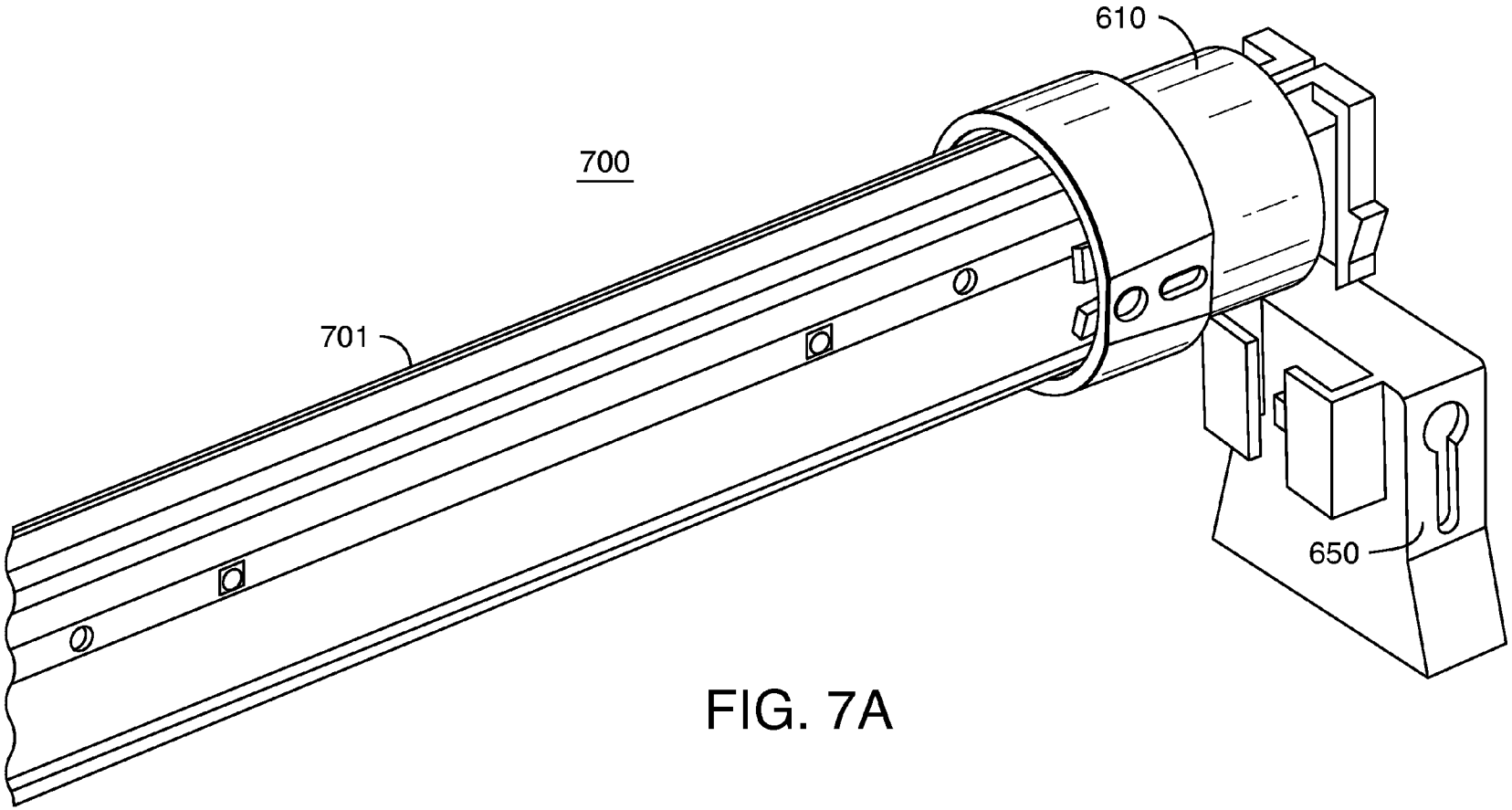
FIGS. 7A and 7B show the light source bracket of FIG. 6A connected to a luminaire and then connected to the tombstone cover of FIG. 6B according to embodiments disclosed herein.
Figure 7B:
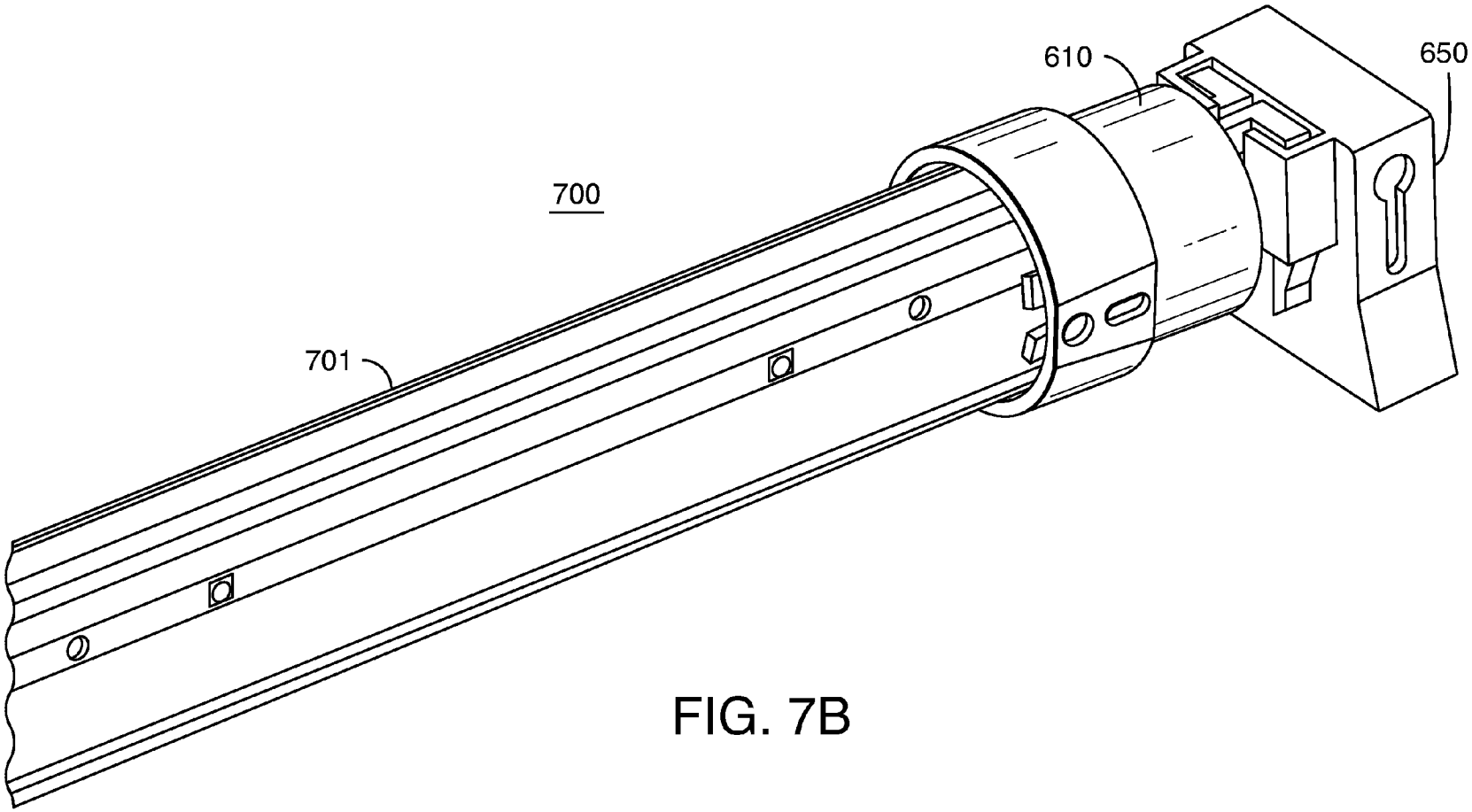

FIGS. 6A-6B and 7A-7B show embodiments of a luminaire adapter 700 formed by a tombstone cover 650 and a light source bracket 610. In FIGS. 6A-6B and 7A-7B, in contrast to FIGS. 1-5, the tombstone cover 650 includes a pair of snap receivers 660 and 670, while the light source bracket 610 includes a pair of snap connectors 620 and 630. FIG. 7A shows a luminaire 701 with the light source bracket 610 attached at one end, and the tombstone cover 650 placed over a tombstone socket (not shown as covered by the tombstone cover 650). FIG. 7B shows the light source bracket 610 connected to the tombstone cover 650, as described in greater detail below, which allows the luminaire 701 to replace a fluorescent lamp without having to remove the tombstone sockets that previously held and powered the fluorescent lamp.

FIG. 6A shows the light source bracket 650 in greater detail. The light source bracket 650 is shaped so as to accept the luminaire 701 (shown in FIGS. 7A-7B). Thus, the light source bracket 650 includes an opening between a top portion 601 and a bottom portion 602, which, in some embodiments, are two separate pieces that are join together and in some embodiments are different parts of the same single piece. The shape of the opening matches, at least in part, the shape of an end of the luminaire. Thus, at least one end of a luminaire is inserted into the opening of the light source bracket 650. The light source bracket 650 attaches to the luminaire 701 using any known mechanical connection, such as but not limited to screws, friction, tensioning, bonding (i.e., glue, cement, epoxy, etc.), or the like. An outer portion of the light source bracket 650 includes the pair of snap connectors 620 and 630, which extend out from the light source bracket 650. Though the pair of snap connectors 620 and 630 are shown in FIG. 6A as linearly extending arms, each with a protruding tab to interact with the pair of snap receivers 660 and 670, the pair of snap connectors may take any known connecting shape.

As shown in FIG. 6B, a housing 680 of the tombstone cover 650 is generally shaped the same as the housing 111 shown in FIGS. 1-2 and 4-5. The housing 680 includes the pair of snap receivers 660 and 670 on a front wall 651 of the housing 680. Though the pair of snap receivers 660 and 670 as shown in FIG. 6B are oppositely arrayed L-shaped clips protruding from the front wall 651 of the tombstone cover 650, the pair of snap receivers may take any known receiver shape that is able to mechanically accept the corresponding pair of snap connectors on the light source bracket 610. In some embodiments, a particular type of pair of snap receivers is able to accept multiple different types of snap connectors.

In some embodiments, there is enough give in the opening of the light source bracket 650 and/or in distance the pair of snap connectors 620 and 630 extend from the light source bracket 650 and/or in the pair of snap receivers 660 and 670 to accommodate luminaires in any of the various spaces that held different types (and lengths) of fluorescent lamps, while still maintaining a solid and secure connection for the luminaire.

In some embodiments, the light source bracket 650 includes a groove 625 that comes into contact with a corresponding post 665 located in (and/or substantially in) the center of the tombstone cover 650. This allows the luminaire 701 to be centered without extra effort or measurements on the part of the installer, while taking into account the tolerances built into the luminaire adapter 700 to work with differently sized luminaires and tombstones, and also serves to help hold the luminaire 701 securly in place.

Though embodiments have been described herein with relation to a luminaire, embodiments are not so limited. Embodiments may alternatively and/or additionally be realized as a light engine/module that fits within a luminaire housing, with the luminaire housing attaching to the light source bracket, without departing from the scope of the invention. Similarly, embodiments may alternatively and/or additionally be realized as a retrofit lamp that fits within a luminaire housing, with the luminaire housing attaching to the light source bracket, without departing from the scope of the invention. Further, some embodiments may be considered a light engine/module instead of a luminaire. In such embodiments, the light engine/module connects to the light source bracket of a luminaire adapter, and fits in place of a fluorescent lamp. In such embodiments, the combination of the luminaire adapter(s) and the light engine/module may itself be considered a luminaire.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A luminaire adapter, comprising:

a tombstone cover, wherein the tombstone cover comprises a housing that defines a slot opening to accept a tombstone socket and a pair of snap connectors; and a light source bracket, wherein the light source bracket comprises a top portion configured to connect to a bottom portion, wherein the bottom portion includes a pair of snap receivers configured to receive the pair of snap connectors, and wherein the top portion and the bottom portion define an opening to receive a luminaire.

2. The luminaire adapter of claim 1, wherein the housing comprises a front wall, a back wall, a pair of side walls, and a housing top, wherein the front wall includes the pair of snap connectors.

3. The luminaire adapter of claim 2, wherein each snap connector in the pair of snap connectors comprises a first tab and a second tab, wherein the first tab and the second tab for each snap connector define a snap opening to receive a corresponding snap receiver of the pair of snap receivers.

4. The luminaire adapter of claim 3, wherein, for at least one snap connector in the pair of snap connectors, the first tab and the second tab are oriented such that the snap opening is parallel to the housing top.

5. The luminaire adapter of claim 3, wherein the first tab and the second tab of a first snap connector in the pair of snap connectors are oriented such that a first snap opening is parallel to the housing top, and wherein the first tab and the second tab of a second snap connector in the pair of snap connectors are oriented such that a second snap opening is perpendicular to the housing top.

6. The luminaire adapter of claim 2, wherein the tombstone cover comprises a first pair of snap connectors and a second pair of snap connectors, and wherein the front wall includes the first pair and the second pair of snap connectors.

7. The luminaire adapter of claim 6, wherein each snap connector in the first pair and the second pair of snap connectors comprises a first tab and a second tab, wherein the first tab and the second tab for each snap connector define a snap opening to receive a corresponding snap receiver of the pair of snap receivers.

8. The luminaire adapter of claim 7, wherein the first tab and the second tab of a first snap connector in the first pair of snap connectors are oriented in a different direction from the first tab and the second tab of a second snap connector in the first pair of snap connectors, and wherein the first tab and the second tab of a first snap connector in the second pair of snap connectors are oriented in a different direction from the first tab and the second tab of a second snap connector in the second pair of snap connectors.

9. The luminaire adapter of claim 7, wherein the first pair of snap connectors are oriented parallel to the housing top and wherein the second pair of snap connectors are oriented perpendicular to the housing top.

10. The luminaire adapter of claim 6, wherein the light source bracket comprises a first pair of snap receivers configured to receive the first pair of snap connectors and a second pair of snap receives configured to receive the second pair of snap connectors.

11. The luminaire adapter of claim 2, wherein the front wall, the back wall, and each of the pair of side walls has an upper portion and a lower portion.

12. The luminaire adapter of claim 11, wherein the lower portion of the front wall and the lower portion of the back wall are each substantially wider than the upper portion of the front wall and the upper portion of the back wall.

13. The luminaire adapter of claim 12, wherein the upper portion of each side wall is substantially perpendicular in relation to the housing top, and wherein the lower portion of each side wall is angled with respect to the upper portion.

14. The luminaire adapter of claim 11, wherein the pair of snap connectors is located on the lower portion of the front wall.

15. The luminaire adapter of claim 1, wherein the top portion comprises a first end and a second end, wherein the bottom portion comprises a rotating end and a receiving end, wherein the first end is rotationally connected to the rotating end and wherein the second end is removably connected to the receiving end.

16. The luminaire adapter of claim 15, wherein the second end comprises a top clip connected to a push tab, wherein the receiving end comprises a bottom clip, and wherein the top clip and the bottom clip, when engaged, are configured to retain a luminaire in the opening, and wherein the push tab is configured to allow the top clip and the bottom clip to be disengaged.

17. The luminaire adapter of claim 1, wherein the top portion comprises a first end and a second end, wherein the first end and the second end each comprise a push tab connected to a corresponding top clip, wherein the bottom portion comprises a first receiving end and a second receiving end, each configured to engage a corresponding top clip of the top portion so as to retain a luminaire in the opening, and wherein the push tab of the first end and the push tab of the second end are each configured to allow the corresponding top clip to be disengaged from its respective receiving end.

18. The luminaire adapter of claim 1, wherein the bottom portion comprises a first pressure clip and a second pressure clip, wherein the first pressure clip and the second pressure clip are configured to engage with a plurality of teeth of a luminaire in the opening when the top portion is connected to the bottom portion so as to allow the luminaire to rotate while simultaneously allowing the luminaire adapter to be stationary.

19. The luminaire adapter of claim 1, wherein the bottom portion and the top portion include a plurality of grooves, wherein the plurality of grooves are configured to match a corresponding plurality of teeth on a luminaire, and wherein the plurality of grooves are configured to interact with the corresponding plurality of teeth to allow the luminaire to rotate while simultaneously allowing the luminaire adapter to be stationary.

20. The luminaire adapter of claim 1, wherein the tombstone cover comprises the pair of snap receivers and wherein the light source bracket comprises the pair of snap connectors.

* * * * *